US006390338B1

(12) United States Patent
Baudin

(10) Patent No.: US 6,390,338 B1
(45) Date of Patent: May 21, 2002

(54) PUMP FOR FITTING TO A RECEPTACLE, THE PUMP INCLUDING AN ELASTICALLY DEFORMABLE MEMBRANE OUTSIDE THE PUMP CHAMBER

(75) Inventor: Gilles Baudin, Domont (FR)

(73) Assignee: L'Oreal, Paris (FR)

( * ) Notice: Subject to any disclaimer, the term of this patent is extended or adjusted under 35 U.S.C. 154(b) by 41 days.

(21) Appl. No.: 09/694,352

(22) Filed: Oct. 24, 2000

(30) Foreign Application Priority Data

Oct. 26, 1999 (FR) ..... 99 13346

(51) Int. Cl.[7] ..... B67D 5/42

(52) U.S. Cl. ..... 222/321.2; 222/321.7; 222/321.9; 222/336

(58) Field of Search ..... 222/321.1, 321.2, 222/321.7, 321.9, 336

(56) References Cited

U.S. PATENT DOCUMENTS

| | | | | |
|---|---|---|---|---|
| 4,252,507 A | | 2/1981 | Knickerbocker | |
| 4,452,379 A | | 6/1984 | Bundshub | |
| 4,607,765 A | | 8/1986 | Ruscitti | |
| 5,014,881 A | * | 5/1991 | Andris | 222/207 |
| 5,152,434 A | * | 10/1992 | Birmelin | 222/207 |
| 5,267,673 A | * | 12/1993 | Crosnier et al. | 222/321.7 |
| 5,518,147 A | * | 5/1996 | Peterson et al. | 222/321.7 X |
| 5,518,377 A | * | 5/1996 | Bougamont et al. | 222/321.9 X |
| 5,544,789 A | * | 8/1996 | Gillingham | 222/207 X |
| 5,687,884 A | * | 11/1997 | Bodin et al. | 222/321.7 |
| 5,704,519 A | * | 1/1998 | Crosnier et al. | 222/321.7 X |
| 5,788,124 A | * | 8/1998 | Bougamont et al. | 222/321.9 X |
| 5,819,990 A | * | 10/1998 | Cimentepe et al. | 222/321.7 X |
| 6,202,896 B1 | * | 3/2001 | Bonningue | 222/321.1 |
| 6,227,414 B1 | * | 5/2001 | Peronnet et al. | 222/321.7 X |

FOREIGN PATENT DOCUMENTS

| | | |
|---|---|---|
| FR | 2 708 314 | 2/1995 |
| FR | 2 746 076 | 9/1997 |

* cited by examiner

*Primary Examiner*—Kenneth Bomberg
(74) *Attorney, Agent, or Firm*—Oliff & Berridge, PLC

(57) ABSTRACT

The invention relates to a pump for fitting to a receptacle, the pump comprising a pump body and a moving assembly movable relative to the body, having a piston that bears in leakproof manner against the body and that co-operates therewith to define a pump chamber of variable volume. The pump also has, outside the pump chamber, an elastically deformable membrane arranged to return the moving assembly into its initial position after delivering a quantity of substance. The moving assembly has a rod with an internal passage for delivering the substance contained in the pump chamber, the internal passage opening out into the pump chamber via at least one outlet orifice and the pump having a piston that is movable relative to the rod between a pre-compression position in which it closes the outlet orifice(s) and a delivery position in which it releases said orifice(s), the piston being moved from its pre-compression position to its delivery position under drive from the pressure of the substance inside the pump chamber.

19 Claims, 4 Drawing Sheets

PUMP FOR FITTING TO A RECEPTACLE, THE PUMP INCLUDING AN ELASTICALLY DEFORMABLE MEMBRANE OUTSIDE THE PUMP CHAMBER

The present invention relates to a pump for fitting to a receptacle, the pump comprising a pump body and an assembly that is movable relative to the body, the assembly comprising a piston bearing in leakproof manner against the body and co-operating therewith to define a pump chamber of variable volume.

BACKGROUND OF THE INVENTION

French patent No. 2 708 314 discloses such a pump that also includes an elastically deformable membrane outside the pump chamber and arranged to return the moving assembly into its initial position after delivering a quantity of substance.

That pump causes the substance contained in the pump chamber to be delivered as soon as the pressure in the chamber begins to increase due to the moving assembly moving downwards.

OBJECTS AND SUMMARY OF THE INVENTION

There exists a need to have a pump of the pre-compression type enabling substance to be delivered at some predetermined minimum pressure, that can be manufactured at relatively low cost, that is agreeable to use, and that operates reliably.

The present invention seeks specifically to satisfy that need.

In the pump of the invention, the moving assembly comprises a rod possessing an internal passage for delivering the substance contained in the pump chamber, the internal passage opening out into the pump chamber via at least one orifice, and the piston is movable relative to the rod between a pre-compression position in which it closes said outlet orifice(s) and a delivery position in which it releases said orifice(s), the piston being moved from its pre-compression position to its delivery position under the effect of the pressure of substance inside the pump chamber.

In a preferred embodiment, the pump chamber communicates with the inside of the receptacle via a duct which is closed by the moving assembly at the beginning of its stroke for delivering a quantity of substance.

Advantageously, the moving assembly is shaped to engage in leakproof manner in the above-mentioned duct so as to close it.

Advantageously, the membrane comprises a sealing skirt that, at rest, bears in leakproof manner via one face against a corresponding bearing surface of the moving assembly to close an air intake passage formed between the membrane and the moving assembly, said sealing skirt being suitable for moving away from said bearing surface when suction is applied to its opposite face in such a manner as to enable air to enter into the receptacle.

This particular embodiment ensures that substance will not leak out through the air intake passage in the event of a reduction in the pressure outside the receptacle, e.g. due to being transported in an airplane.

The air intake passage is open only when the inside of the receptacle is at a pressure that is lower than the pressure that exists outside it.

Advantageously, the moving assembly has an annular rib to which the membrane is secured, said rib being provided with at least one slot for enabling air to be taken in.

In a particular embodiment, an air intake hole is made through the pump body, said air intake hole being separated from the inside of the pump body by the piston when the moving assembly is in its initial position, the piston enabling communication to take place between the air intake hole and the inside of the pump body above the piston when the moving assembly has moved over a predetermined stroke inside the pump body to reduce the volume of the pump chamber.

This prevents the substance contained in the receptacle from reaching the space that lies between the piston and the membrane, while the pump is at rest.

The piston is preferably fitted onto the rod.

In a particular embodiment, the piston is urged into its pre-compression position by a spring.

Still in a particular embodiment, the piston is arranged to deform elastically so as to release the outlet orifice(s).

In which case, advantageously, the piston has an annular sealing wall suitable for bearing against the pump body and against the rod so as to isolate the outlet orifice(s) of the pump chamber while the chamber is being filled, and an elastically deformable return wall bearing against the rod and suitable for deforming elastically to enable the annular sealing wall to be moved and to enable communication to be established between said outlet orifice(s) and the pump chamber while delivering a quantity of substance.

Advantageously, said return wall is deformed under the effect of the pressure of the substance inside the pump chamber.

The axial section of the piston can be generally λ- or Σ- or X-shaped, for example.

Preferably, the above-mentioned return wall of the piston bears against a shoulder on the rod.

In a particular embodiment, the moving assembly has an end acting as a barb snap-fastened in a housing of the pump body.

The invention also provides a receptacle fitted with a pump as defined above.

BRIEF DESCRIPTION OF THE DRAWINGS

The invention will be better understood on reading the following detailed description of non-limiting embodiments, and on examining the accompanying drawings, in which.

MORE DETAILED DESCRIPTION

Figure 1:
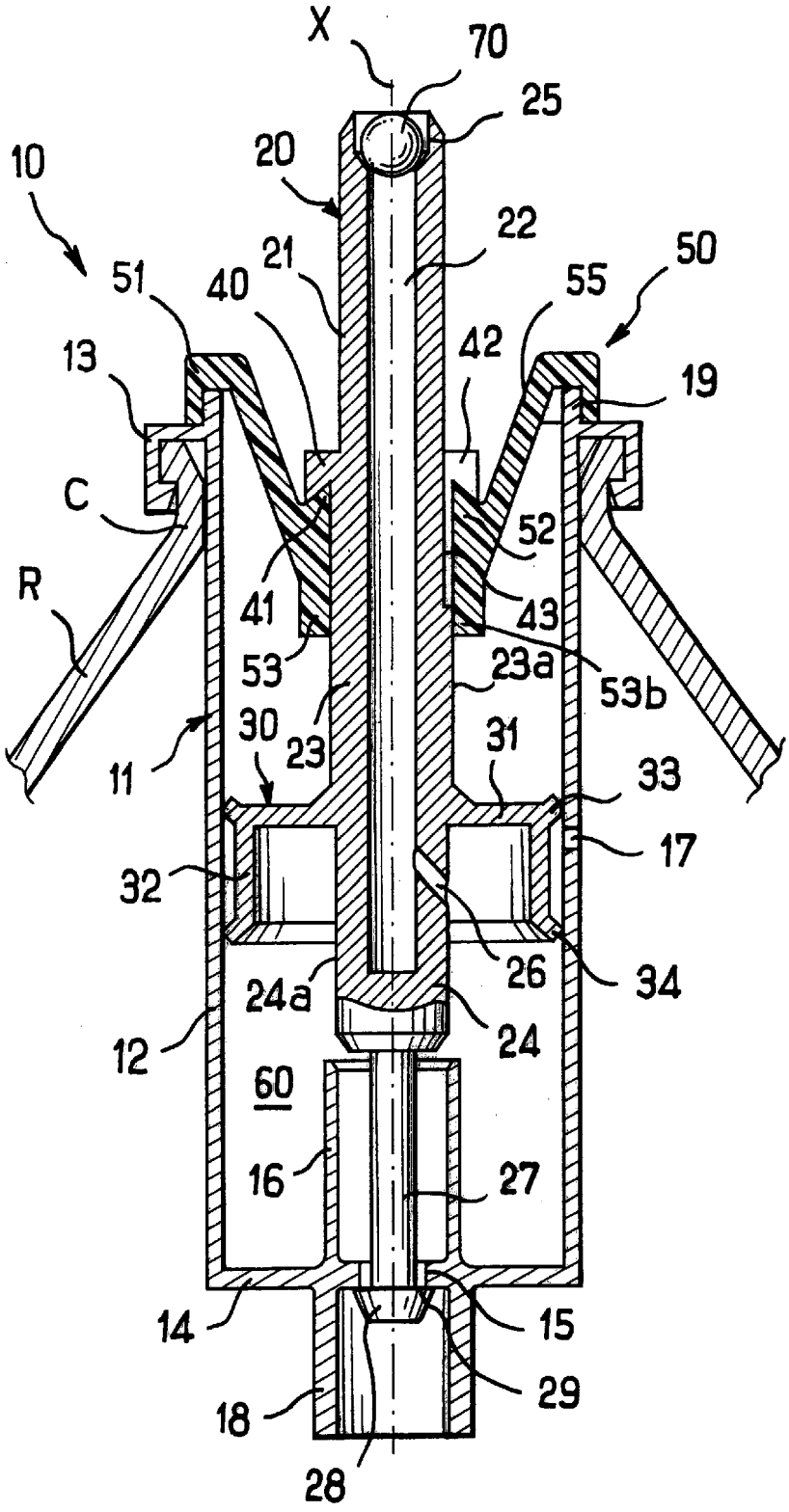
FIG. 1 is a diagrammatic axial section view of a pump, shown for the purpose of making certain features of the invention easier to understand.

The pump 10 shown in FIG. 1 is for mounting on a receptacle R of which only the neck C is shown.

The pump 10 comprises a pump body 11 and an assembly 20 that is movable relative to the pump body 11 along an axis X.

The body 11 has a wall 12 that is circularly cylindrical about the axis X, being provided at its top end with a rim 13 for engaging the neck C of the receptacle R.

The bottom end of the wall 12 is connected to a bottom wall 14 having an orifice 15 passing through its center.

A duct 16 that is circularly cylindrical about the axis X is connected to the top face of the bottom wall 14.

An endpiece 18 that is likewise circularly cylindrical about the axis X is connected to the bottom face of the bottom wall 14 for receiving a dip tube (not shown) extending to the bottom of the receptacle R when the pump 10 is intended for use with the receptacle oriented so that the pump is at the top.

An air intake hole 17 is made through the wall 12, about half-way along it.

The moving assembly 20 comprises a hollow rod 21 about the axis X, defining an internal passage 22 through which the substance is delivered.

The moving assembly 20 also includes a piston 30, the piston having an annular wall 31 extending substantially perpendicularly to the axis X, and being extended downwards by a tubular wall 32, top and bottom annular sealing lips 33 and 34 being formed respectively where the walls 31 and 32 join and at the bottom end of the wall 32.

The lips 33 and 34 bear in leakproof manner against the inside surface of the wall 12.

Beneath the level of the wall 31 of the piston 30, the rod 21 has a bottom portion 24 with an outside surface 24*a* which is circularly cylindrical about the axis X and which presents a diameter that corresponds to the inside diameter of the duct 16.

The internal passage 22 opens out to the surface 24*a* via a radial orifice 26.

The bottom portion 24 is extended downwards by a fastening portion 27 that acts as a barb, whose tip 28 presents a shoulder 29 that, at rest, bears against the bottom face of the bottom wall 14 around the orifice 15, as shown in FIG. 1.

An elastically deformable membrane 50 has a central portion 52 engaged on the rod 21.

Above the wall 31 of the piston 30, the rod has an annular rib 40 whose bottom portion forms a downwardly open notch 41 serving to retain the central portion 52 of the membrane 50.

The membrane can be made of a material selected from the following list: nitrile elastomer; silicone elastomer, BUNA™; vulcanized elastomers; and thermoplastic elastomers.

The piston can be made of a material selected from the following list: low density polyethylene (LDPE); ethylene vinyl acetate (EVA); ethylene maleic anhydride (EMA); and SANTOPRENE™.

The intermediate portion 23 of the rod 21 which extends between the rib 40 and the wall 31 of the piston is of a diameter which is slightly greater than that of the rod above the rib 40.

The rib has a radial slot 42 which extends downwards over a fraction of the height of the central portion 52 of the membrane, thereby forming a passage 43.

The thickness of the passage 43 corresponds to the difference between the outside diameter of the rod 21 above the rib 40 and its outside diameter in its intermediate portion 23.

The top portion 51 of the membrane 50 is shaped to engage on the top end 19 of the wall 12 above the rim 13.

The central portion 52 of the membrane 50 is shaped to engage in the notch 41 via its top end, and at its bottom end it has a sealing skirt 53 whose own bottom end bears via a face 53*b* against the outside surface 23*a* of the intermediate portion 23 of the rod 21 beneath the bottom end of the passage 43, thereby closing the passage.

When the membrane 50 is at rest, the space 61 situated inside the wall 12 between the piston and the membrane is isolated from the outside.

The central portion 52 of the membrane 50 is connected to the top portion 51 by an upwardly diverging, substantially conical sloping wall 55.

The piston 30 co-operates with the pump body 11 beneath the wall 31 to define a pump chamber 60.

At its top end, the rod 21 has a housing 25 whose bottom serves as a seat for a ball 70 so as to constitute a check valve.

The rod 21 is engaged in a conventional pushbutton (not shown) which also serves to retain the ball 70 in the housing 25.

To assemble the pump 10, the membrane 50 is engaged on the rod 21 from the top so as to position the central portion 52 in the notch 51 of the rib 40.

The moving assembly 20 fitted with the membrane 50 is then engaged from the top in the body of the pump 11 until the bottom end 28 of the fastening portion 27 passes through the orifice 15 by elastic deformation.

The membrane 50 is then under a small amount of tension, such that the shoulder 29 is caused to bear against the bottom face of the bottom wall 14, as shown in FIG. 1.

The air intake hole 17 is situated between the annular lips 33 and 34 of the piston 30 and is thus isolated from the inside of the pump body.

The pump operates as follows.

It is assumed that the pump chamber 60 is full of substance.

To deliver a quantity of the substance, the user moves the moving assembly 20 downwards.

Figure 2:
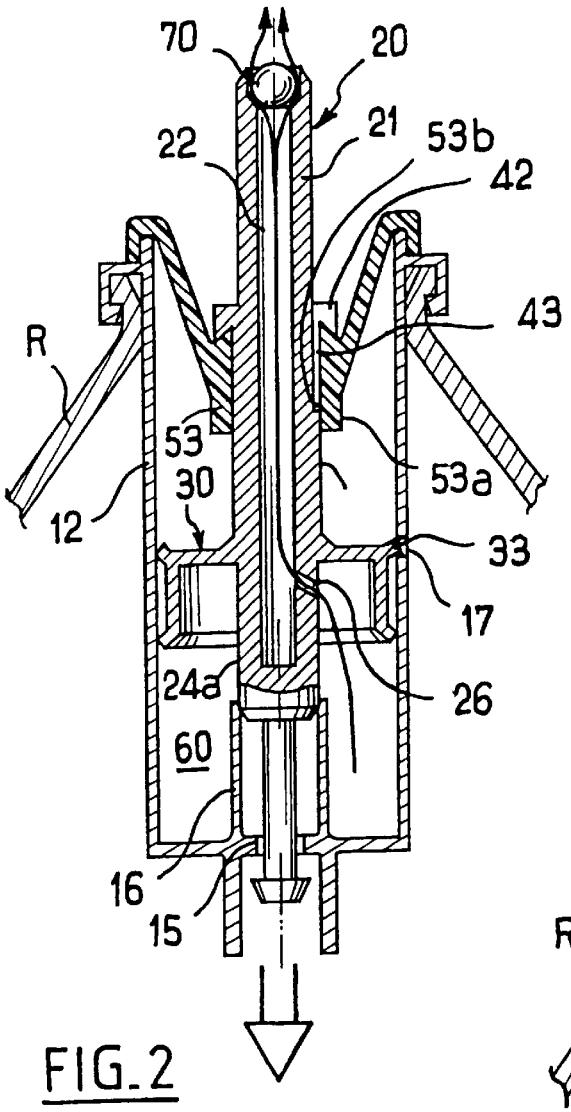
FIGS. 2 and 3 show different stages in the operation of the FIG. 1 pump.

The outside surface 24*a* of the bottom portion 24 of the rod 21 rapidly comes to bear against the inside surface of the duct 16, thereby isolating the pump chamber 60 from the orifice 15, as shown in FIG. 2.

As the downward movement of the piston 30 continues, the substance contained in the pump chamber 60 is compressed and expelled through the outlet orifice 26 so as to rise along the internal passage 22 in the hollow rod 21, with the ball 70 lifting under the effect of the pressure of the substance, and enabling the substance to reach the pushbutton and thus be collected by the user.

The membrane 50 stretches and stores energy elastically, thereby making it possible, when the user releases the pushbutton, to return the moving assembly 20 into its initial position.

During the downward movement of the piston 30, the top sealing lip 33 moves to below the level of the air intake hole 17.

If pressure inside the receptacle R is lower than pressure outside, then this applies suction through the air intake hole 17 on the outside face 53*a* of the sealing skirt 53.

Figure 3:
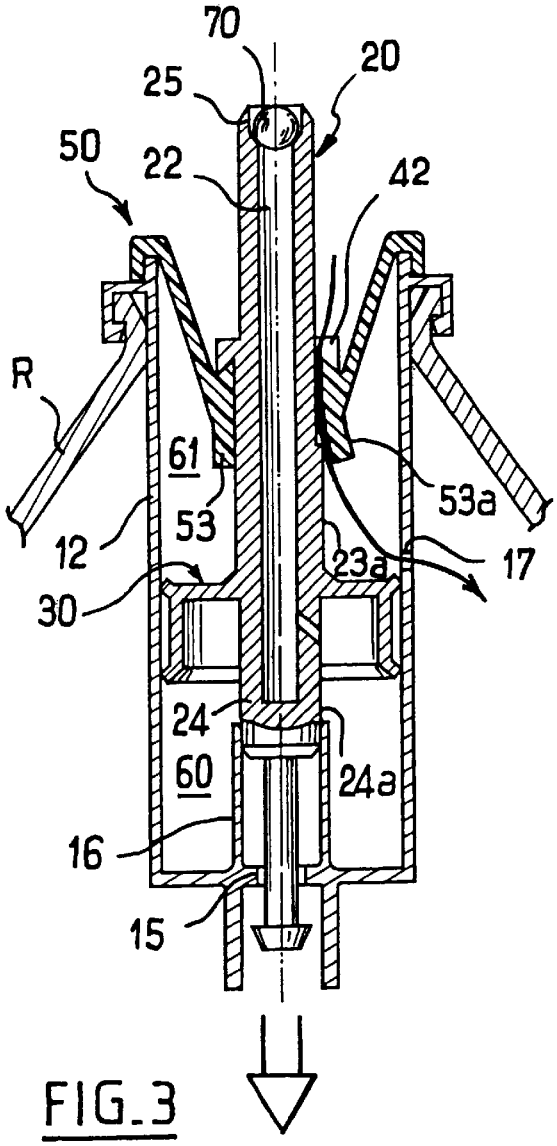

The inside face 53*b* of the skirt 53 is subject to atmospheric pressure via the passage 43 and the pressure difference on opposite sides of the skirt 53 causes it to lift off the surface 23*a* of the rod 21. Air can thus be taken in, as shown in FIG. 3.

When the user releases the pushbutton, the moving assembly 20 rises under drive from the membrane 50 which tends to return to its initial shape.

The ball 70 is then pressed against the bottom of the housing 25 and prevents air being taken in via the internal passage 22.

Suction is established in the pump chamber 60 and when the bottom portion 24 of the rod 21 leaves the duct 16, a quantity of substance is sucked in through the orifice 15.

Figure 4:
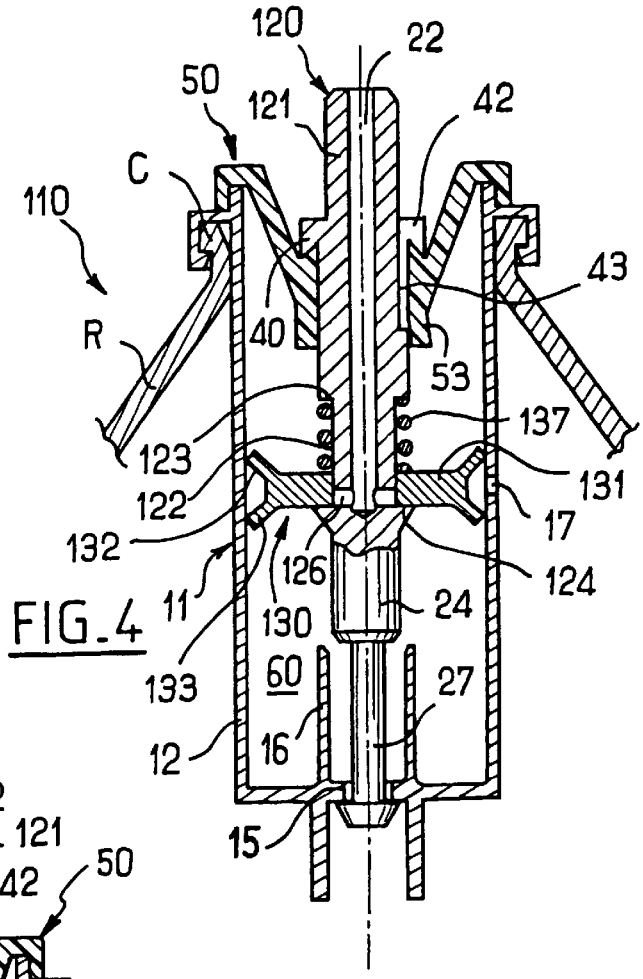
FIG. 4 is a diagrammatic axial section view of a pump constituting a first embodiment of the invention.

FIG. 4 shows a pump 110 of the invention comprising a pump body 11 and a membrane 50 that are identical to those of the pump 10 described above.

The pump 110 has a moving assembly 120 which comprises a hollow rod 121 and a piston 130.

The moving assembly 120 differs from the moving assembly 20 in that there is no check valve with a ball 70 and in that the piston 130 is not integrally molded with the rod 121 but is in the form of an element fitted to the rod 121 and can move relative thereto.

The bottom portion 24 and the portion of the rod for securing the membrane So are identical to those of the rod 21.

Immediately above its bottom portion 54, the rod 121 has an annular groove 122 defined at the top by a shoulder 123 and at the bottom by a shoulder 124.

The bottom of the groove 122 is circularly cylindrical about the axis X, and is of smaller diameter than the bottom portion 24.

The internal passage 22 opens out via a plurality of radial orifices 126 into the bottom of the groove 122 close to the shoulder 124.

The piston 130 has a disk-shaped central portion 131 provided at its periphery with two annular sealing lips, an upwardly-directed top lip 132 and a downwardly-directed bottom lip 133, which lips bear in leakproof manner against the inside surface of the wall 12.

The central wall 131 of the piston 130 slides along the axis X in leakproof manner against the bottom of the groove 122.

A helical return spring 137 that works in compression bears at its top end against the shoulder 123 and at its bottom end against the top face of the central portion 131 to urge the piston 130 to move downwards.

When the pump is at rest, i.e. in the configuration shown in FIG. 4, the piston 130 bears against the shoulder 124, with the central portion 131 closing the orifices 126 and with the sealing lips 132 and 133 bearing against the wall 12 respectively above and below the air intake hole 17.

The pump 110 operates as follows.

When the user moves the moving assembly 120 downwards, the bottom portion 24 of the rod 121 bears against the inside surface of the duct 16, thereby isolating the pump chamber 60 from the orifice 15.

As the downward movement of the moving assembly 120 continues, the pressure of the substance contained in the pump chamber 60 increases until it becomes sufficient to move the piston 130 against the bias of the return spring 137.

The pump 110 is said to be a pre-compression pump since the substance contained in the pump chamber 60 cannot leave it in order to be delivered until the pressure in the pump chamber 60 exceeds a predetermined limit.

Thus, the pump 110 enables the substance to be delivered at some predetermined minimum pressure, which is advantageous when the pushbutton is fitted with a spray nozzle.

As soon as the top sealing lip 132 comes below the level of the air intake hole 17, air intake can take place by lifting the sealing skirt 53 in the same manner as for the above-described pump 10.

When the user releases the pushbutton, the moving assembly 120 rises under drive from the membrane 50, with the piston 130 closing the orifices 126 so that air is prevented from being sucked into the pump chamber 60.

Figure 5:
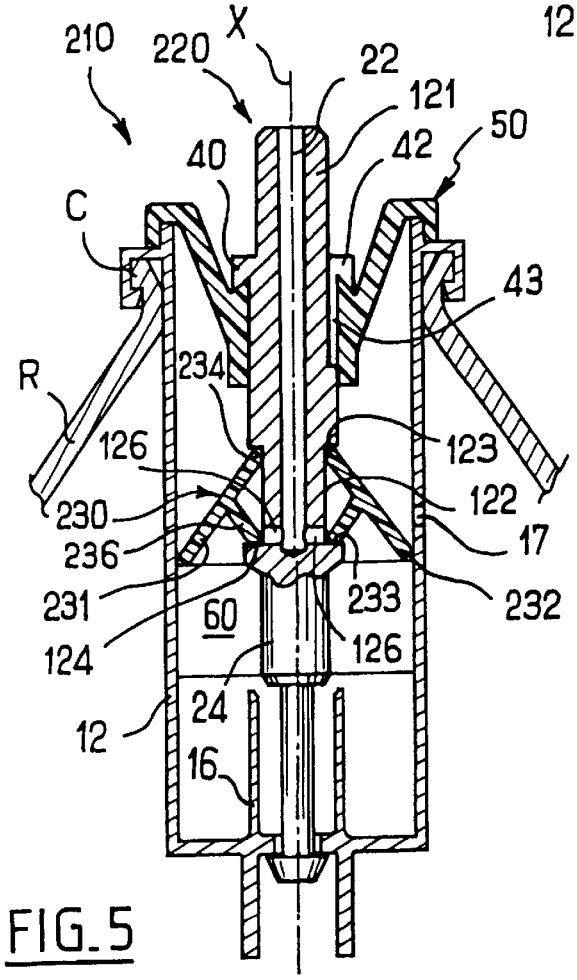
FIG. 5 is a diagrammatic axial section view of a pump constituting a second embodiment of the invention.

The pump 210 of the invention and shown in FIG. 5 is of the pre-compression type like the pump of FIG. 4, and differs therefrom solely by the fact that the moving assembly 220 has a deformable piston 230 instead of the piston 130 and its return spring 137.

In axial section, the piston 230 is generally λ-shaped, with a bottom annular wall formed by two portions 231 and 232 bearing via their respective free ends 232 and 233 on the inside surface of the wall 12 and against the bottom of the groove 122.

The top portion of the piston 230 has an elastically deformable wall 234 whose top end bears against the shoulder 123 and whose bottom end connects with the junction between the portions 231 and 236.

At rest, the end 233 of the piston 230 bears against the shoulder 124 and isolates the orifices 126 from the pump chamber 60.

Figure 6:
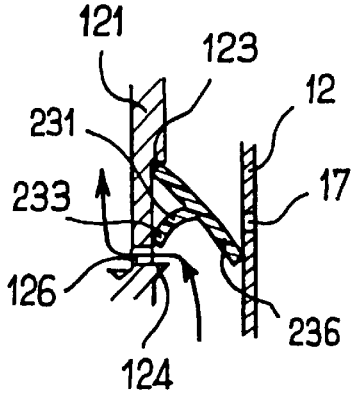
FIG. 6 shows the piston of FIG. 5 after it has deformed.

When the moving assembly 220 is moved down inside the pump body 11 and the bottom portion 24 bears against the inside surface of the duct 16, the pressure in the pump chamber increases and deforms the piston 230, as shown in FIG. 6.

The end 233 of the portion 231 moves above the orifices 126 and as a result the substance contained in the pump chamber 60 can reach the internal passage 22 of the rod 121.

The deformable piston can be made to have various shapes without going beyond the ambit of the present invention.

Figure 7:
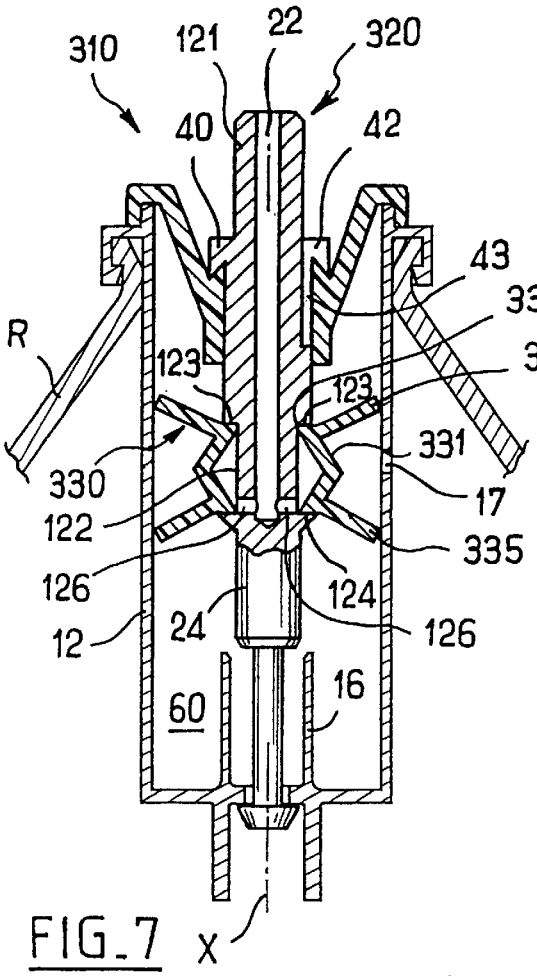
FIG. 7 is a diagrammatic axial section view of a pump constituting a third embodiment of the invention.
Figure 8:
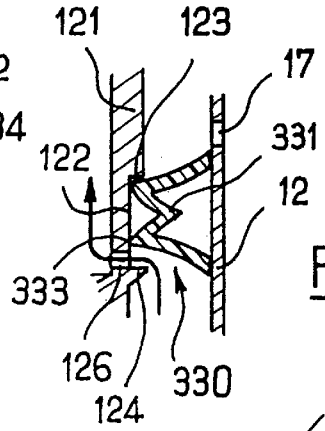
FIG. 8 shows the piston of FIG. 7 after it has deformed.

By way of example, FIGS. 7 and 8 show two variants of the pump 310 and 410 comprising movable assemblies 320 and 420 in which the piston is not λ-shaped, but is respectively Σ-shaped or X-shaped.

The Σ-shaped piston 330 of the pump 310 has a central portion 331 that is >-shaped with top and bottom ends 332 and 333 connected to two respective portions 334 and 335. At rest, the top and bottom ends 332 and 333 bear respectively against the shoulders 123 and 124.

The free ends of the portions 334 and 335 bear against the inside surface of the wall 12 respectively above and below the air intake hole 17 when the pump is at rest, as shown in FIG. 7.

When the pressure in the pump chamber 60 increases, the piston 330 deforms with the central portion 331 tending to flatten as shown in FIG. 8.

Above a certain pressure, the deformation is sufficient for the bottom end 333 to bear against the rod 121 above the outlet orifices 126, thereby allowing the substance to reach the internal passage 22.

Figure 9:
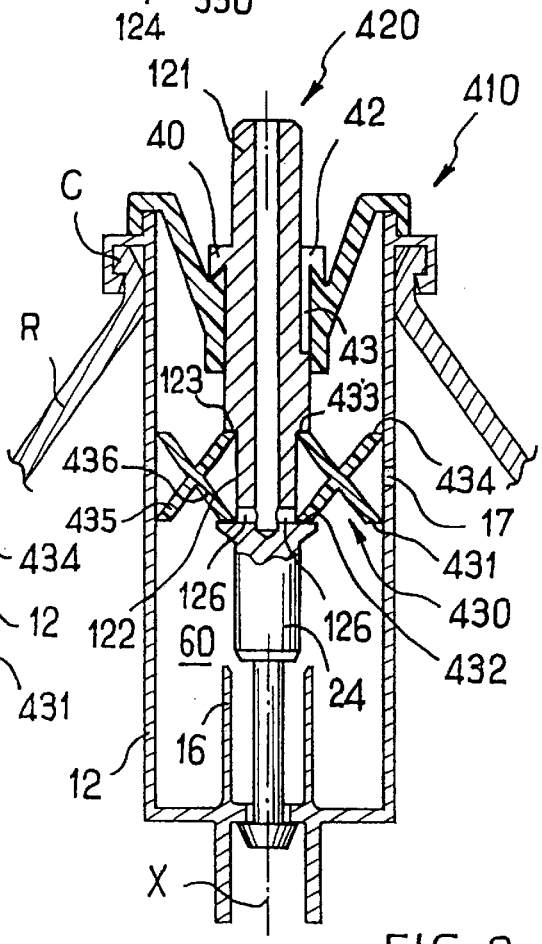
FIG. 9 is a diagrammatic axial section view of a pump constituting a fourth embodiment of the invention.
Figure 10:
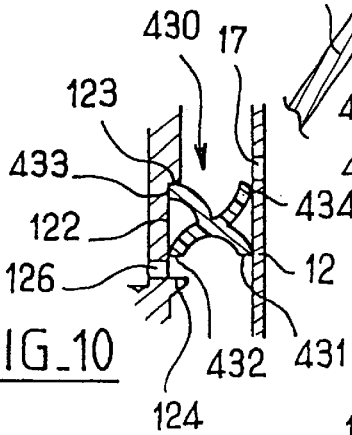
FIG. 10 shows the piston of FIG. 9 after it has deformed.

The X-shaped piston 430 in FIGS. 9 and 10 has two bottom portions 432 and 431 whose respective ends bear against the rod 121 and against the wall 12, and it has two top portions 433 and 434 which bear respectively against the shoulder 123 and the wall 12.

At rest, the portions 431 and 434 bear against the wall 12 respectively below and above the air intake hole 17.

The portion 432 bears against the shoulder 124.

When the pressure in the pump chamber 60 increases, the piston 430 deforms with the portions 431, 432, 433, and 434 tending to become arcuate.

Above a certain pressure inside the pump chamber 60, the outlet orifices 126 are uncovered, as shown in FIG. 10.

Naturally, the invention is not limited to the embodiments described above.

In particular, the piston can be given other shapes.

What is claimed is:

1. A pump for fitting to a receptacle, the pump comprising a pump body and a moving assembly that is movable relative to the body, the assembly having a piston that bears in leakproof manner against the body and that co-operates therewith to define a pump chamber of variable volume, the pump also including outside the pump chamber an elastically deformable membrane arranged to return the moving assembly into its initial position after delivering a quantity of substance, wherein the moving assembly comprises a rod possessing an internal passage for delivering the substance contained in the pump chamber, the internal passage opening out into the pump chamber via at least one orifice, and wherein the piston is movable relative to the rod between a pre-compression position in which it closes said outlet orifice(s) and a delivery position in which it releases said orifice(s), the piston being moved from its pre-compression position to its delivery position under the effect of the pressure of substance inside the pump chamber.

2. A pump according to claim 1, wherein the membrane comprises a sealing skirt that, at rest, bears in leakproof manner via one face against a corresponding bearing surface of the moving assembly to close an air intake passage formed between the membrane and the moving assembly, said sealing skirt being suitable for moving away from said bearing surface when suction is applied to its opposite face in such a manner as to enable air to enter into the receptacle.

3. A pump according to claim 2, wherein the moving assembly has an annular rib to which the membrane is secured, said rib being provided with at least one slot for enabling air to be taken in.

4. A pump according to claim 1, wherein the piston is arranged to deform elastically so as to release the outlet orifice(s).

5. A pump according to claim 4, wherein the piston has an annular sealing wall suitable for bearing against the pump body and against the rod so as to isolate the outlet orifice(s) of the pump chamber while the chamber is being filled, and an elastically deformable return wall bearing against the rod and suitable for deforming elastically to enable the annular sealing wall to be moved and to enable communication to be established between said outlet orifice(s) and the pump chamber while delivering a quantity of substance.

6. A pump according to claim 5, wherein said return wall is deformed under the effect of the pressure of the substance inside the pump chamber.

7. A pump according to claim 6, wherein the axial section of the piston is generally λ-shaped.

8. A pump according to claim 6, wherein the axial section of the piston is generally Σ-shaped.

9. A pump according to claim 6, wherein the axial section of the piston is generally X-shaped.

10. A pump according to claim 5, wherein the return wall of the piston bears against a shoulder on the rod.

11. A pump according to claim 1, wherein the piston is fitted on the rod.

12. A pump according to claim 1, wherein the piston is urged into its pre-compression position by a spring.

13. A pump according to claim 1, wherein the pump chamber communicates with the inside of the receptacle via a duct which is closed by the moving assembly at the beginning of its stroke for delivering a quantity of substance.

14. A pump according to claim 13, wherein the moving assembly is shaped to engage in leakproof manner in said duct so as to close it.

15. A pump according to claim 1, wherein an air intake hole is made through the pump body, said air intake hole being separated from the inside of the pump body by the piston when the moving assembly is in its initial position, the piston enabling communication to take place between the air intake hole and the inside of the pump body above the piston when the moving assembly has moved over a predetermined stroke inside the pump body to reduce the volume of the pump chamber.

16. A pump according to claim 1, wherein the moving assembly has an end acting as a barb snap-fastened in a housing of the pump body.

17. A pump according to claim 1, wherein the membrane is made of a material selected from the following list: nitrile elastomer; silicone elastomer, BUNA™; vulcanized elastomers; and thermoplastic elastomers.

18. A pump according to claim 1, wherein the piston is made of a material selected from the following list: LDPE; EVA; EMA; and SANTOPRENE™.

19. A receptacle fitted with a pump as defined in claim 1.

* * * * *